US005927516A

United States Patent [19]

Berry

[11] Patent Number: 5,927,516

[45] Date of Patent: Jul. 27, 1999

[54] CONCEALED SACK HOLDER AND BAG DISPENSER

[76] Inventor: Homer H. Berry, 2716 Rudy Rd. Cir., Van Buren, Ark. 72956

[21] Appl. No.: 08/824,431

[22] Filed: Mar. 26, 1997

[51] Int. Cl.[6] ..... B42F 7/00

[52] U.S. Cl. ..... 211/51; 221/271

[58] Field of Search ..... 211/51, 184, 59.3; 221/271, 276

[56] References Cited

U.S. PATENT DOCUMENTS

| | | | |
|---|---|---|---|
| 272,263 | 2/1883 | Kenyon . | |
| 1,482,193 | 1/1924 | Hume . | |
| 2,031,147 | 2/1936 | Doolin | 24/259 |
| 3,083,067 | 3/1963 | Vos et al. | 211/59.3 X |
| 3,900,109 | 8/1975 | Peterson | 211/60 |
| 3,986,649 | 10/1976 | Heimstra | 224/42.46 B |
| 4,525,882 | 7/1985 | Stenberg | 211/184 X |
| 5,060,809 | 10/1991 | Bayes et al. | 211/59.1 |
| 5,143,332 | 9/1992 | Camilleri | 248/95 |
| 5,161,702 | 11/1992 | Skalski | 211/59.3 |
| 5,269,416 | 12/1993 | DeMatteis | 211/50 |
| 5,632,409 | 5/1997 | Raghunanan | 211/45 |

FOREIGN PATENT DOCUMENTS

| | | | |
|---|---|---|---|
| 510942 | 10/1992 | European Pat. Off. | 211/184 |
| 19231 | 8/1913 | Germany | 211/51 |
| 91826 | 3/1938 | Germany | 211/51 |
| 118660 | 4/1947 | Germany | 211/51 |
| 4382 | 7/1893 | Sweden | 211/51 |
| 3223 | of 1869 | United Kingdom | 211/51 |
| 15749 | of 1888 | United Kingdom | 211/51 |
| 9786 | of 1892 | United Kingdom | 211/51 |
| 16116 | of 1905 | United Kingdom | 211/51 |

*Primary Examiner*—Daniel P. Stodola
*Assistant Examiner*—Erica B. Harris
*Attorney, Agent, or Firm*—Stephen D. Carver

[57] ABSTRACT

A bag and sack storage dispenser comprising a housing that is secured to a mounting surface, preferably on the interior of a kitchen cabinet door. The housing comprises an integral frame that supports sacks or bags or other planar items during storage. The frame depends from a vertical base that mounts directly to the mounting surface. A horizontal support panel extends outwardly from the door and base. An auxiliary support panel may also extend outwardly from the door and the base. The auxiliary panel extends parallel to but beneath the primary support panel. Each panel has at least one elongated slot penetrating its surface, although there may be more. The slots preferably run parallel to one another and perpendicularly intersect the base. An elongated leg protrudes outwardly from each slot toward the base. Each leg has a foot on one end that secures the leg to the panel. The foot comprises a follower that moves in the slot. The other leg end comprises a terminal, resilient end that is oriented toward the cabinet door or other base attachment surface. A biasing assembly ensures that each leg is normally biased toward the cabinet door or other base attachment surface. In the preferred embodiment, a spring biases the leg. One spring end attaches to the foot inside the frame and the other end attaches adjacent the base in a retaining assembly. In an alternative embodiment, an integral arcuate segment biases the leg and the foot attaches in the retaining assembly.

1 Claim, 13 Drawing Sheets

CONCEALED SACK HOLDER AND BAG DISPENSER

BACKGROUND OF THE INVENTION

I. Field of the Invention

The present invention relates generally to structures for storing and dispensing bags. More specifically the present invention relates to a sack holder and dispenser preferably mounted on a cabinet door that transfers the weights of the stored sacks to the door. Known relevant prior art may be found in the U.S. Class 211 and the various subclasses thereunder.

II. Description of the Prior Art

As will be immediately recognized by those skilled in the art, specialized sack holders have been widely used in several industries for numerous years. In particular, grocery stores and other retail stores routinely use bag holders and/or dispensers at their check-out counters. Such holders/dispensers are convenient devices for storing sacks and subsequently dispensing them.

Several prior art devices have been proposed for dispensing bags. Kenyon, U.S. Pat. No. 272,263, discloses a paper bag holder including a spring of peculiar form arranged to press upon the bags and follow them down when one or more are removed to keep those remaining securely in place and including lower fixed arms or supports upon which the bags rest.

Doolin U.S. Pat. No. 2,031,147 discloses a bag rack including a plurality of clips which grab the upper surface of each bag and allow the remainder of the bag to hang freely therefrom. Hume, U.S. Pat. No. 1,482,193, discloses a device for presumably clamping a single bag to a grain delivery chute.

Camilleri, U.S. Pat. No. 5,143,332, shows a sliding receptacle for dispensing bags. This device appears to be primarily directed to holding open bags for loading.

U.S. Pat. No. 5,269,416, issued to DeMatteis, shows a rack for storing and dispensing specialized bags. U.S. Pat. No. 5,060,809, issued to Bayes et al. is very similar to the structure of DeMatteis. However, both of these devices appear to be unable to accommodate conventional bags of varying sizes and types.

However, the above referenced devices fail to adequately address several deficiencies with existing sack holding and/or dispensing devices. First of all, most devices are designed primarily for commercial installations. Consequently, many of these devices simply do not adapt well to home use. Furthermore, these commercial devices are often quite specialized and mission specific, often failing to address the needs of do-it-yourselfers. For example, many commercial holders are designed to fit only one bag size. However, the typical home user needs a device that accommodates conventional bags of various sizes and shapes. Moreover, since most commercially available sack holders and dispensers are usually quite specialized, they are also normally expensive.

Another perceived problem with known prior art holders involves sack slippage. Most simple prior art holders use a spring tensioned clip to hold the sacks during storage. However, the spring tensioning often fails to properly store the sacks as the device ages. Further, the spring tensioners are often overloaded. Once overloaded, the devices begin dropping sacks. One method of overcoming problems with spring tensioned holders has been to manufacture holders and accompanying bags with specific tabs for retention. However, again these specific bags and holders usually increase costs and do not work for all types of bags.

An improved sack holder would securely support stored sacks until dispensing. An ideal holder would provide a platform to at least partially support the sacks until dispensing. Such a holder would ideally accommodate a diverse variety of sacks and bags.

A desirable sack holder and dispenser would fit a wide variety of cabinet doors commonly found in most homes. Ideally, it could be cheaply manufactured from inexpensive plastic with minimal moving parts to maximize trouble free operation.

Another improvement would permit the user to selectively segregate different sizes of bags. For example, the user could put relatively large bags in one location while putting relatively smaller bags in another location. Thus, the user could accurately select the proper bag size for a given task.

SUMMARY OF THE INVENTION

My improved sack holder and bag dispenser overcomes several of the above referenced problems with known prior art devices. The holder and bag dispenser comprises a housing that is secured to a mounting surface, such as a cabinet door. The housing comprises an integral frame that supports plastic or paper sacks or bags, or a variety of other planar items for convenient storage.

Preferably, the frame utilizes a vertical base that mounts directly to the door. A horizontal support panel extends outwardly from the door and base. An auxiliary support panel may also extend outwardly from the door and the base. Preferably, the auxiliary panel extends parallel to but beneath the primary support panel.

Each panel has at least one elongated slot penetrating its surface, although there may be as many as two or three or more slots. The slots preferably run parallel to one another and they should be generally vertically oriented with respect to the base.

An elongated leg protrudes outwardly from each slot toward the base. Thus, if there is only one slot, there is only one leg. If there are two parallel slots, there are two parallel legs, etc.

Each leg has a foot on one end that secures the leg to the panel. The foot comprises a follower that is slidably captivated in the slot. The other leg end comprises a terminal, resilient end that is oriented toward the cabinet door or other base attachment surface.

A biasing spring ensures that each leg is normally biased toward the cabinet door or other base attachment surface. One spring end attaches to the foot inside the frame. The other spring end attaches adjacent the base. Thus, the spring tensions the leg and end toward the base to secure stored items between the end and the cabinet door.

Thus, the primary object of the present invention is to provide a sack holder and dispenser that permits the user to easily insert sacks for storage until dispensing.

Another object of the present invention is to provide a holder of the type and character herein described that is easily installed and used by a homeowner.

A related object of the present invention is to provide a holder of the type and character herein described that may be installed using few tools and with little training or instruction.

Another important object is to provide a storage holder of the character described that easily accommodates either paper or plastic sacks or bags.

Yet another object of the present invention is to provide a holder that supports the weight of the bags to securely store them.

A basic object of the present invention is to provide a sack holder to which sacks may be easily inserted, removed and stored.

Another object of the present invention is to provide a sack holder for storing different sizes of sacks.

A related object of the present invention is to provide a sack holder that may segregate different sizes of sacks.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
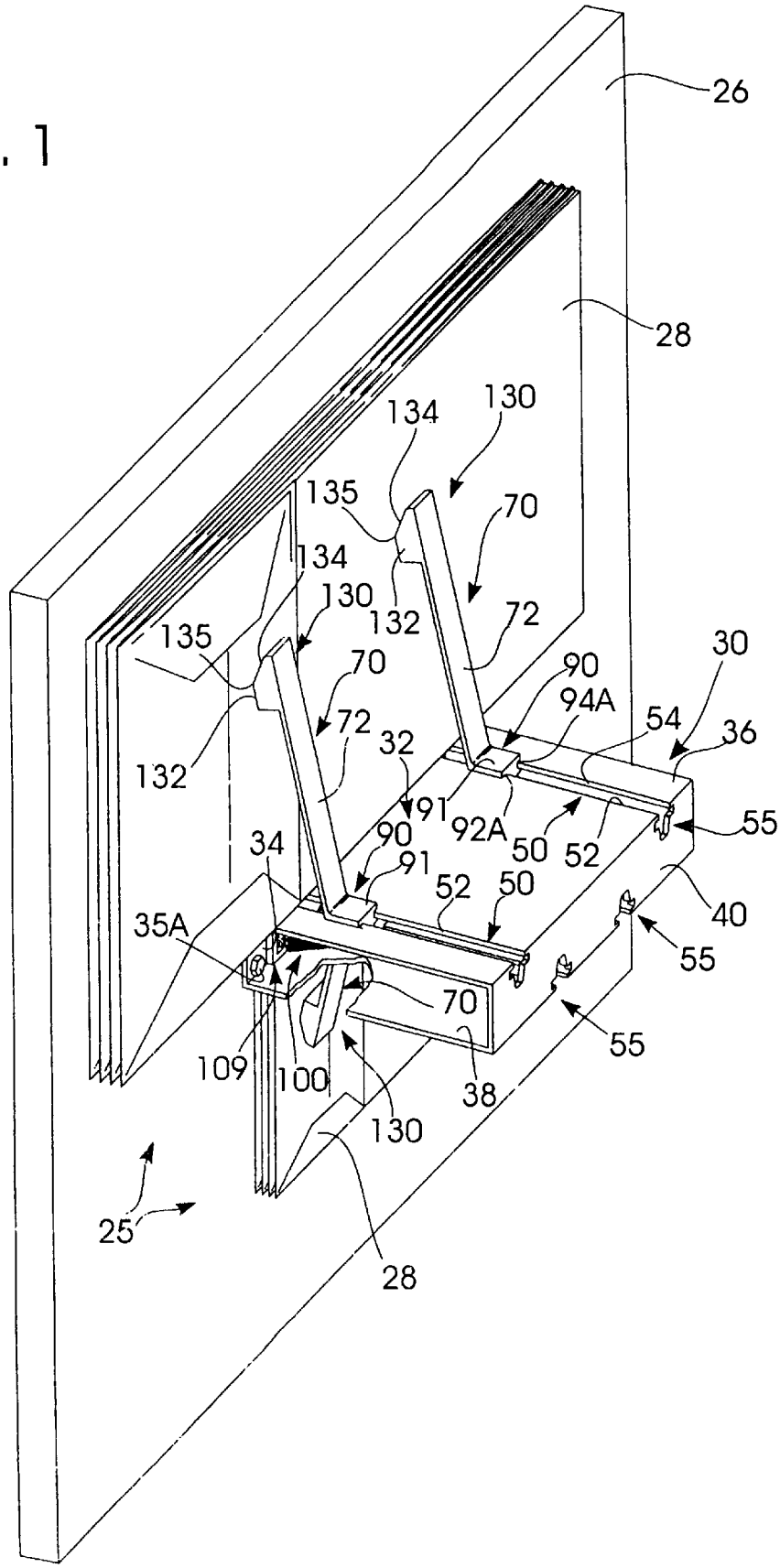
FIG. 1 is a partially fragmented, environmental view of a preferred embodiment of my bag holder and dispenser with bags stored therein, with portions broken away or omitted for clarity.
Figure 2:
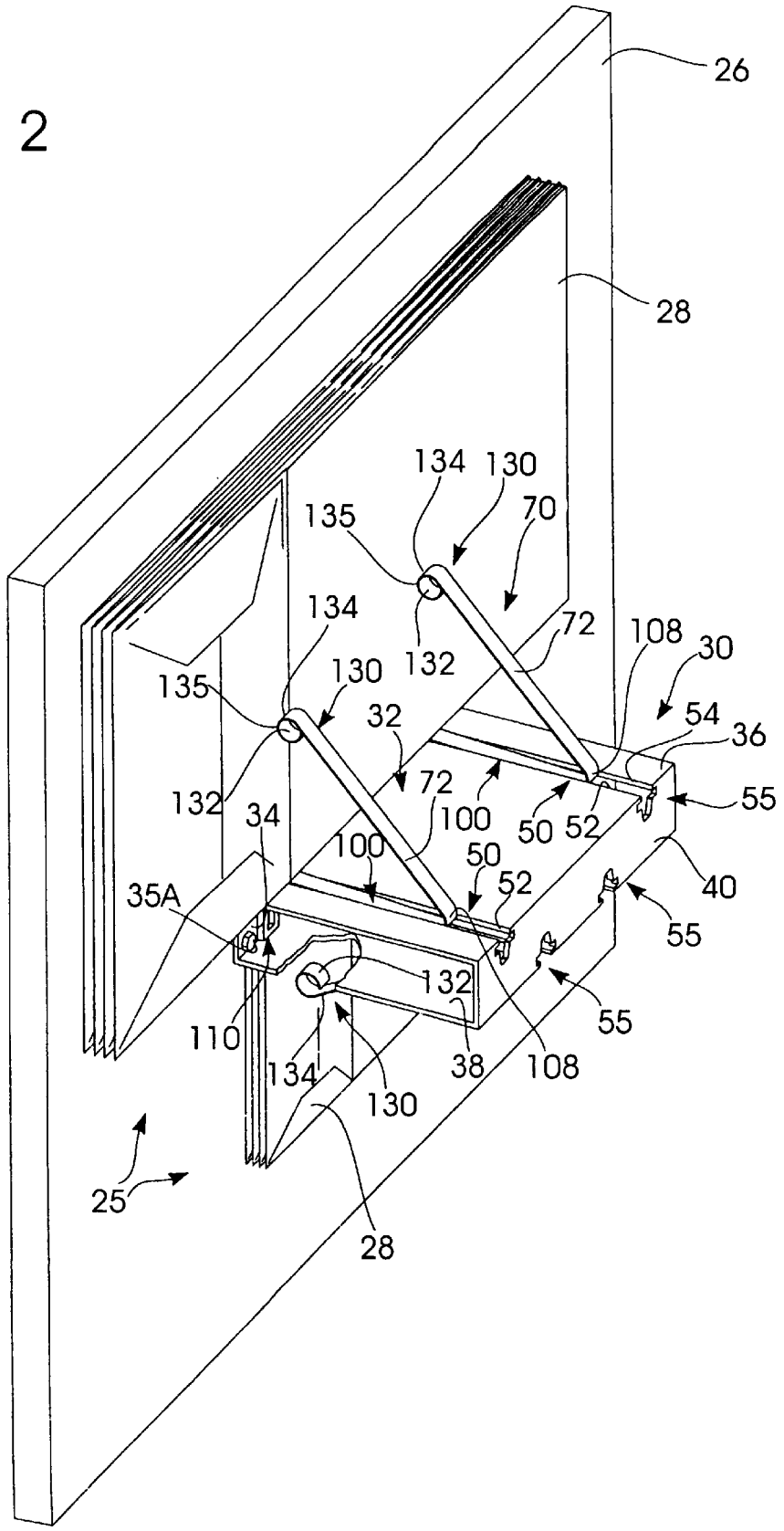
FIG. 2 is a partially fragmented, environmental view of an alternative embodiment of my bag holder and dispenser with bags stored therein, with portions broken away or omitted for clarity.

Referring more specifically to the drawings, my improved Sack Holder and Dispenser is generally designated by the reference 25 in FIGS. 1–14. The holder 25 is designed to be used in conjunction with an interior cabinet door 26 or the like to securely retain inserted bags or sacks 28 until dispensed (FIGS. 1–2). Holder 25 is ideal for either plastic or paper sacks or bags. Of course, holder 25 could be used for any other type of planar article that was to be inserted and stored for a time before dispensing. Furthermore, the holder 25 does not have to necessarily be attached to a door, it could also be attached to a wall or similar flat vertical object.

Figure 3:
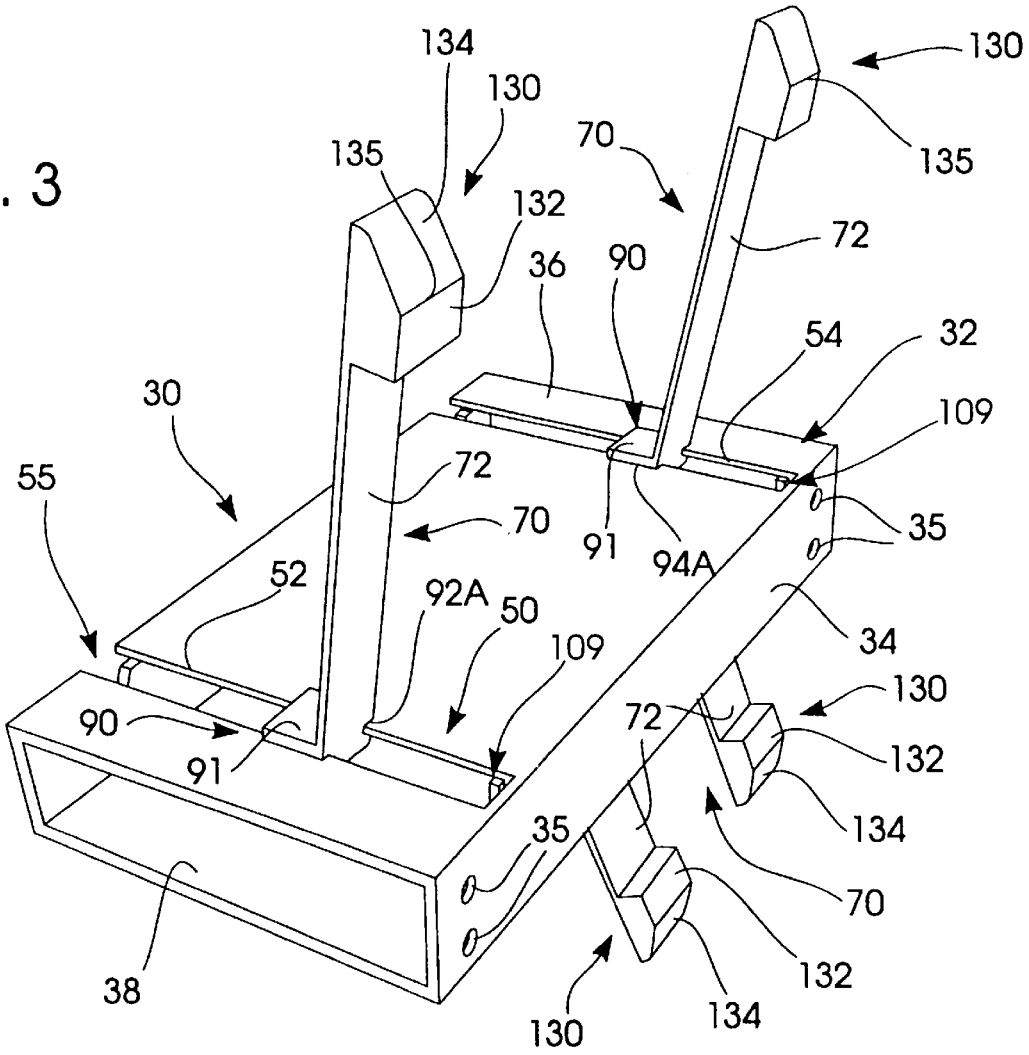
FIG. 3 is a perspective view of the preferred embodiment, taken generally from the front of the invention.
Figure 4:
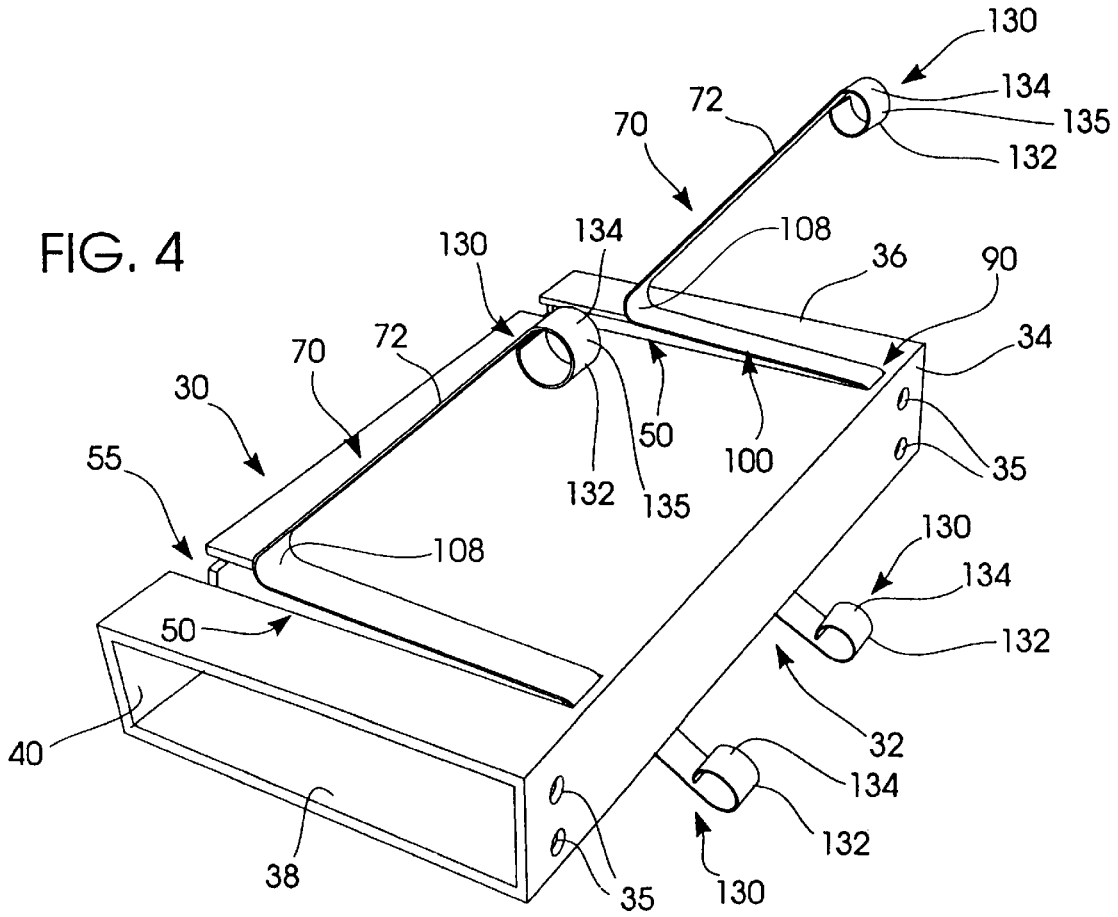
FIG. 4 is a perspective view of the alternative embodiment, taken generally from the front of the invention.
Figure 5:
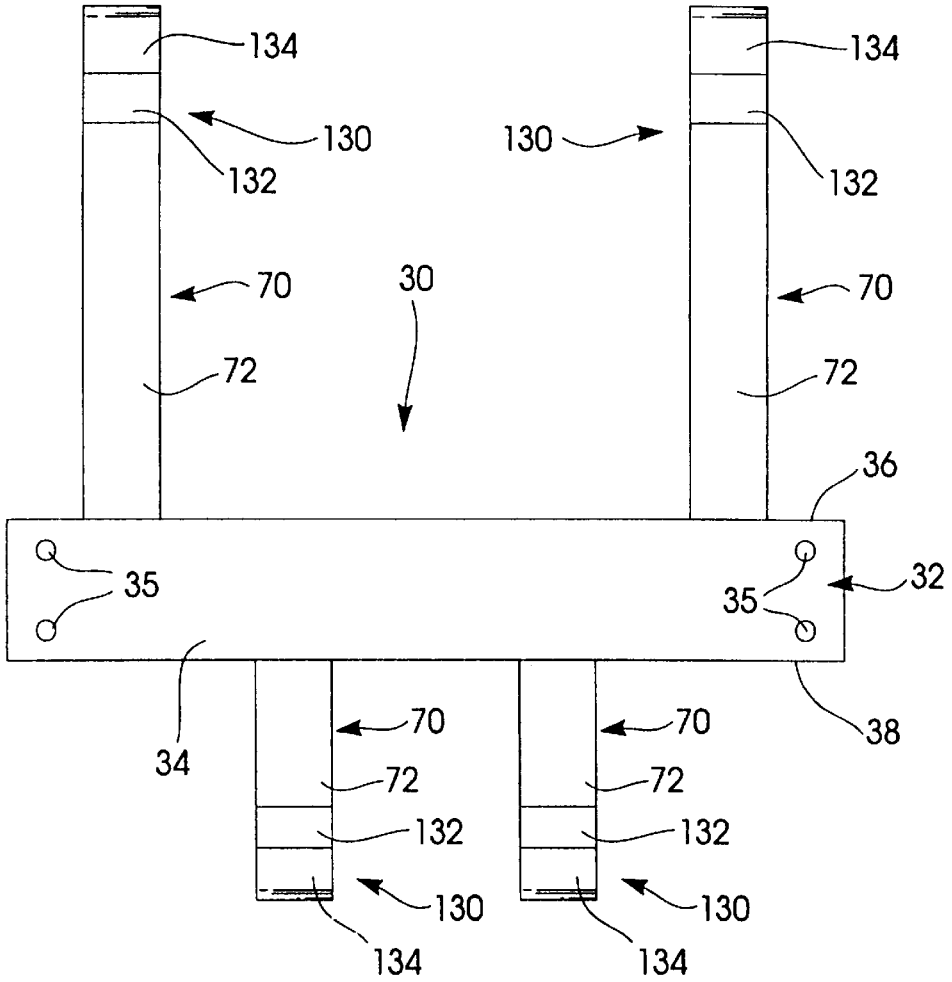
FIG. 5 is a front elevational view of the preferred embodiment.
Figure 6:
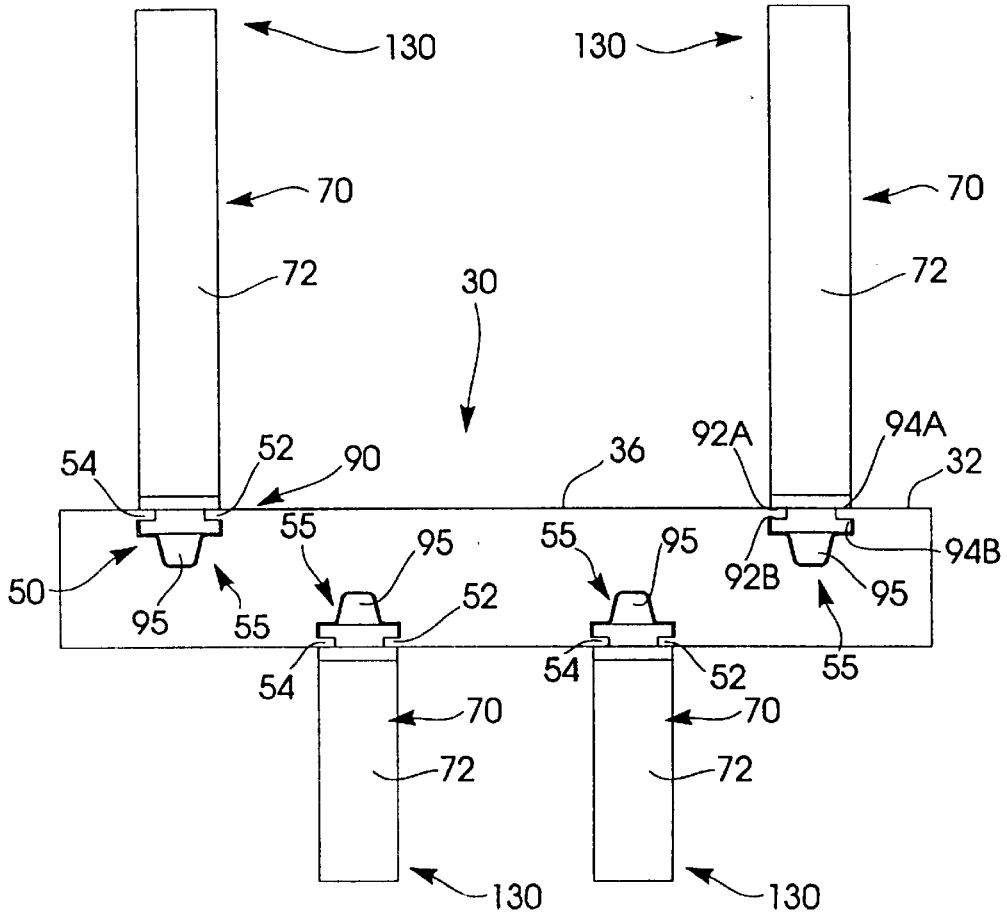
FIG. 6 is a rear elevational view of the preferred embodiment.
Figure 7:
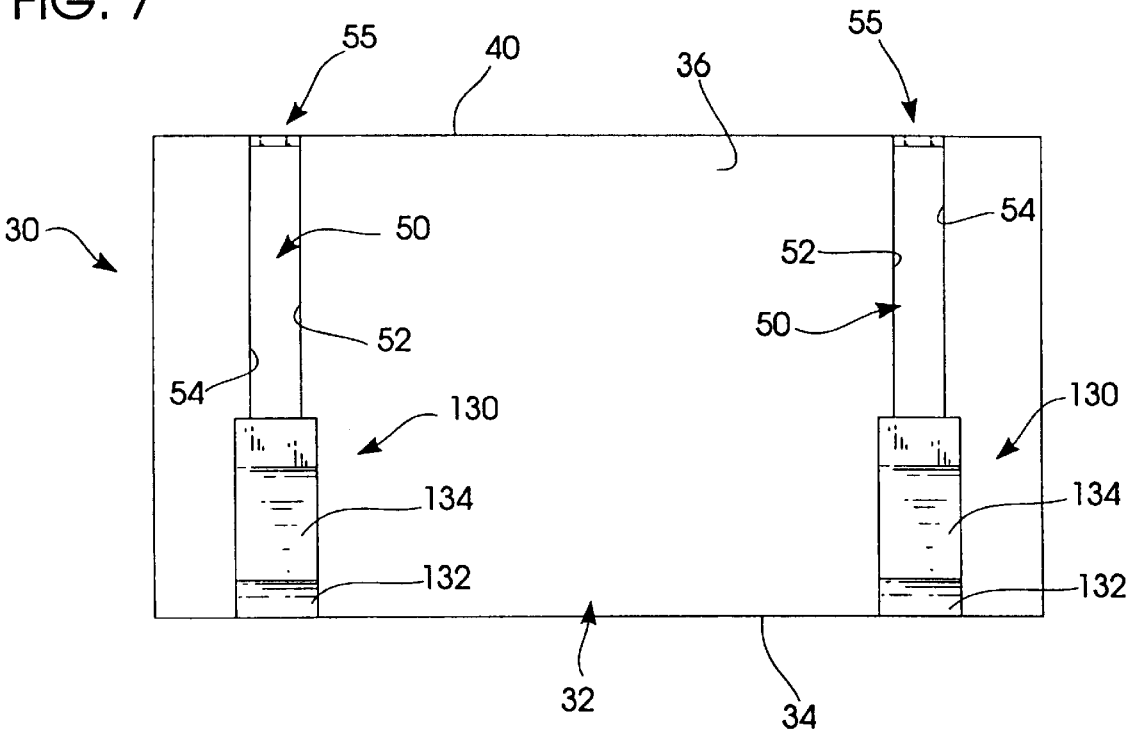
FIG. 7 is a top plain view of the preferred embodiment.
Figure 8:
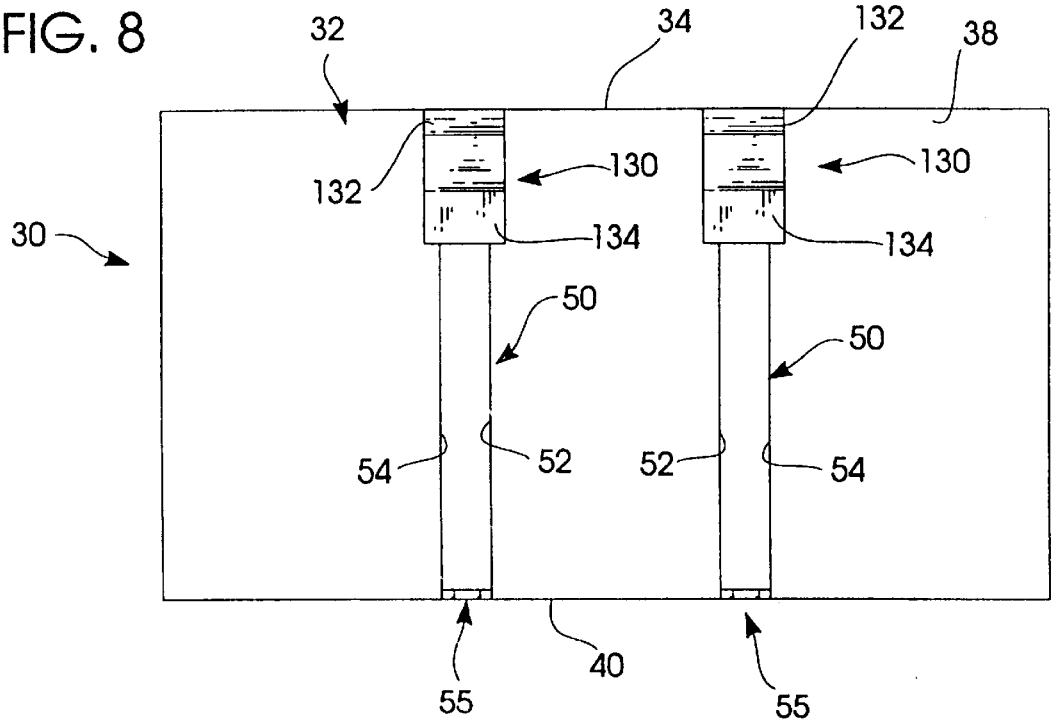
FIG. 8 is a bottom plain view of the preferred embodiment.

Holder 25 comprises a unitary housing 30. Housing 30 comprises an integral frame 32 (most clearly shown in FIGS. 3–8). Frame 32 comprises a vertically oriented base 34. Base 34 is penetrated by several holes 35 that facilitate attachment to door 26 via screws 35A (FIGS. 1,2). Primary support panel 36 extends outwardly from base 34, preferably horizontally. An auxiliary panel 38 may also be formed and extend outwardly from the base 34. Preferably, auxiliary support panel 38 is beneath and parallel to primary panel 36 (FIGS. 3,4).

An auxiliary spacing base 40 may extend across the distal ends of panel 36 and auxiliary panel 38 to appropriately position and reinforce panels 36, 38. Base 34, panels 36, 38 and auxiliary base 40 cooperatively form an open ended, parallelepiped tube (FIG. 1).

Frame 32 may be formed from wood, metal or plastic. Preferably, it is injection-molded from a thermoplastic resin. It has been found that one quarter inch (¼") thick plastic will work suitably to support up to fifteen (15) pounds of stored sacks. Importantly, and as will be discussed more thoroughly hereinafter, the holder 25 uses the door 26 to support a portion of the weight of the sacks (FIGS. 1–2).

In both the preferred and alternative embodiments, at least one elongated slot 50 is defined in each panel 36, 38. Preferably slot 50 extends normally across each panel 36, 38 to transversely intersect base 34. However, it is contemplated that at least two such slots 50 will normally penetrate each panel (FIGS. 1–4). Of course more slots 50 could be defined in each panel if desirable. Since it is contemplated that slots having the same lengths are easier to manufacture, both the preferred and alternative embodiments shown herein have slots of equal lengths. However, slots having different lengths may be used if desirable. Each slot 50 comprises an interior lip 52 and an exterior lip 54. If auxiliary panel 40 is in use, an installation channel 55 penetrates panel 40 adjacent each slot 50. Each elongated slot 50 captivates an elongated leg 70 (FIGS. 3,4).

In the preferred embodiment (FIGS. 1, 3, 5–9), each leg 70 comprises an elongated body 72 extending from foot 90 to end 130. Preferably, body 72 is a thin flat resilient material that may be slightly deformed if necessary. Of course, if more than one slot 50 is defined in a panel 36 or 38, more than one leg should also be employed on the panel. Ideally, all legs on each should have similar dimensions. However, legs on a different panel may have different dimensions to more efficiently segregate sacks of differing sizes. Thus, as shown in FIGS. 1–14, the legs on primary panel 36 are longer than the legs on auxiliary panel 38.

Body 72 extends from an integral foot 90 to an integral, terminal resilient 110. When installed, leg 70 protrudes upwardly and outwardly from slot 50 toward door 26. Each foot 90 slides in slot 50 via a tongue and groove arrangement (FIGS. 1,2).

Figure 11:
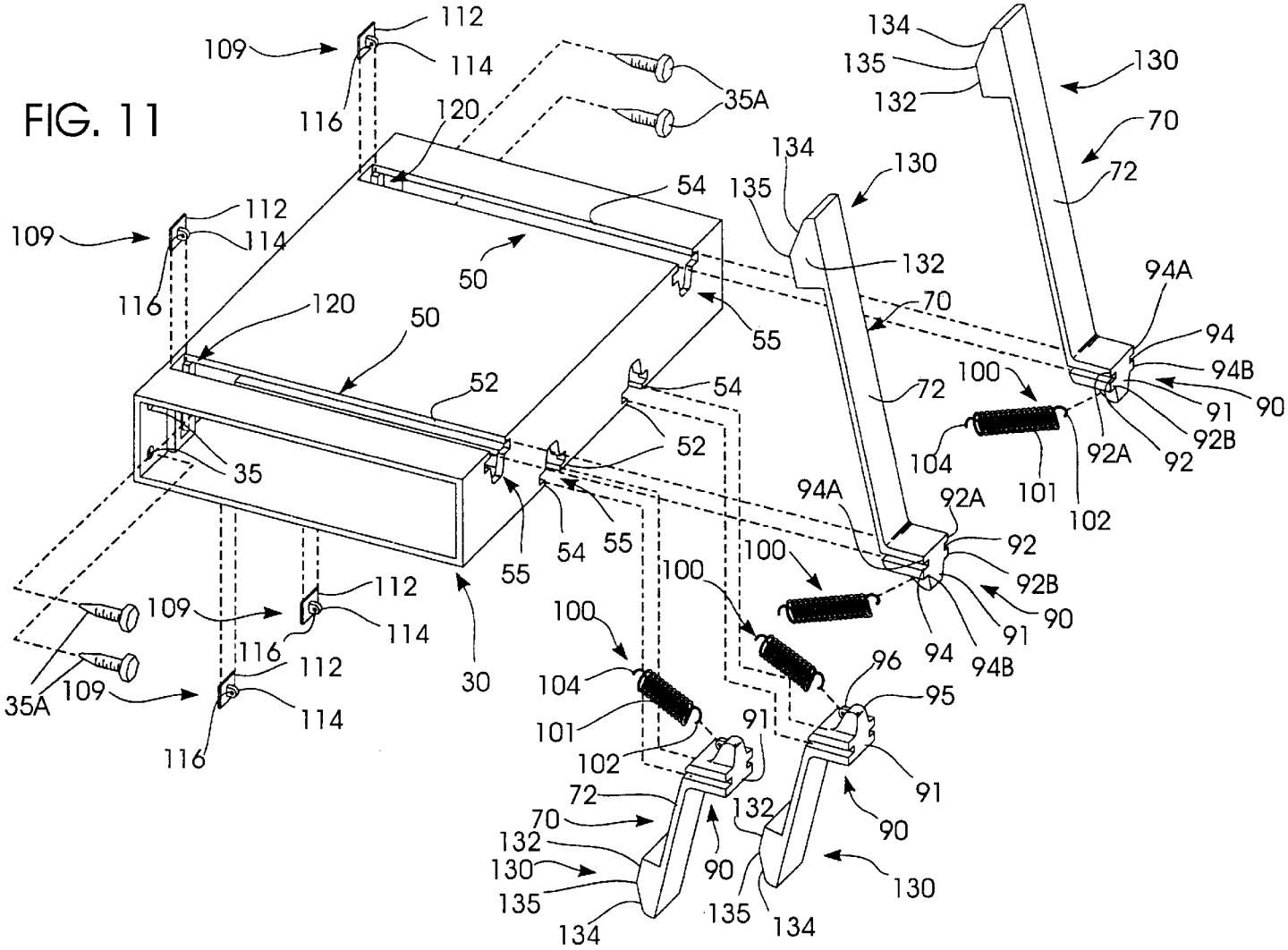
FIG. 11 is an enlarged, exploded isometric view of the preferred embodiment with portions broken away or omitted for clarity.

Each foot 90 comprises a solid body 91 that defines a pair of groves 92, and 94. Grooves 92 and 94 each have upper and lower lips 92A, 92B and 94A, 94B respectively. Grooves 92 and 94 permit foot 90 to slide rearwardly or forwardly upon slot boundary tongues 52, 54 (FIG. 11) as indicated by arrow 93 in FIG. 9. As foot 90 moves rearwardly or forwardly, end 130 also moves rearwardly or forwardly. An integral tab 95 extends inwardly from body 91. Tab 95 is penetrated by a spring receptive orifice 96 (FIG. 11). A biasing assembly 100 biases terminal end 130 against door 26, thus preventing unhindered rearward movement so that inserted bags are held securely.

In the preferred embodiment, biasing assembly 100 comprises a spring 101 that extends from foot 90 to a retaining assembly 110 comprising a clip 112 housed in sheath 120. Spring end 102 penetrates orifice 96 while spring end 104 penetrates clip tab 114 with a similar orifice 116 on assembly 110 (FIG. 11).

Figure 10:
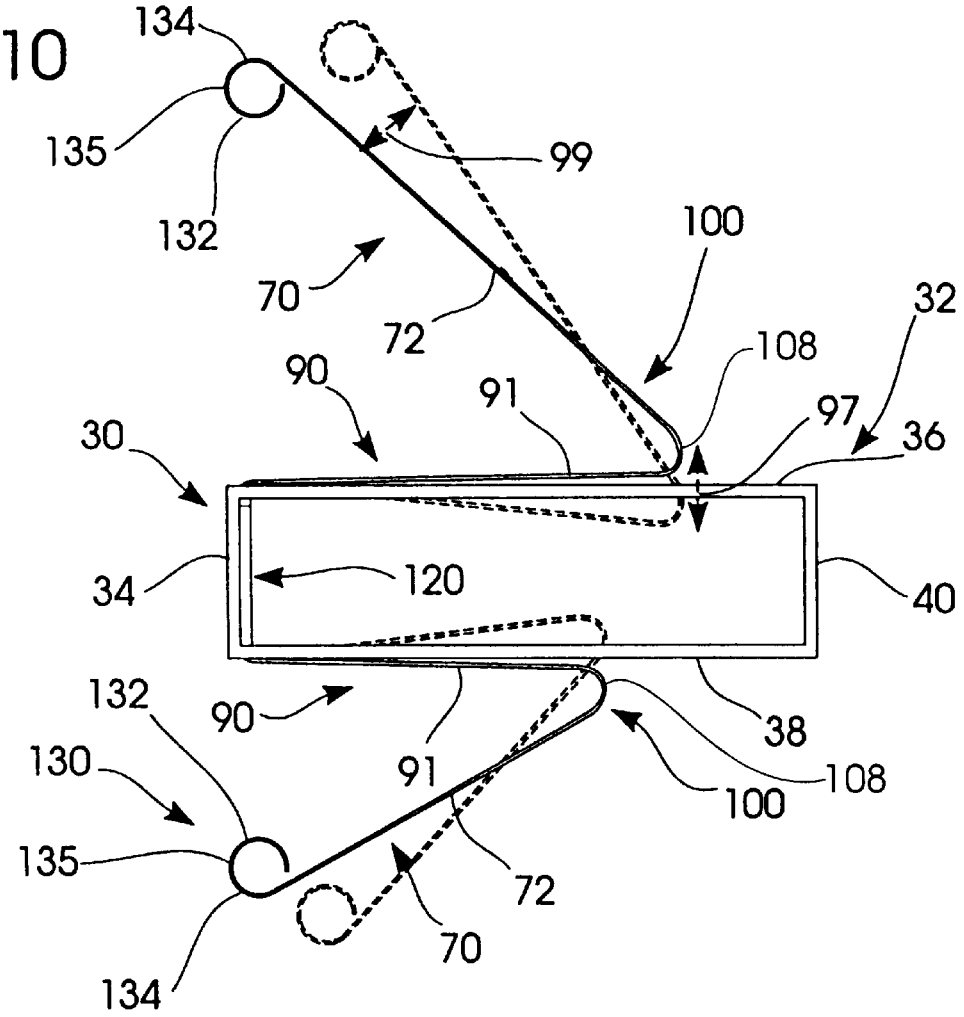
FIG. 10 is a partially fragmented, side elevational view of the alternative embodiment with portions broken away or omitted for clarity, with dashed lines showing a moved position.
Figure 12:
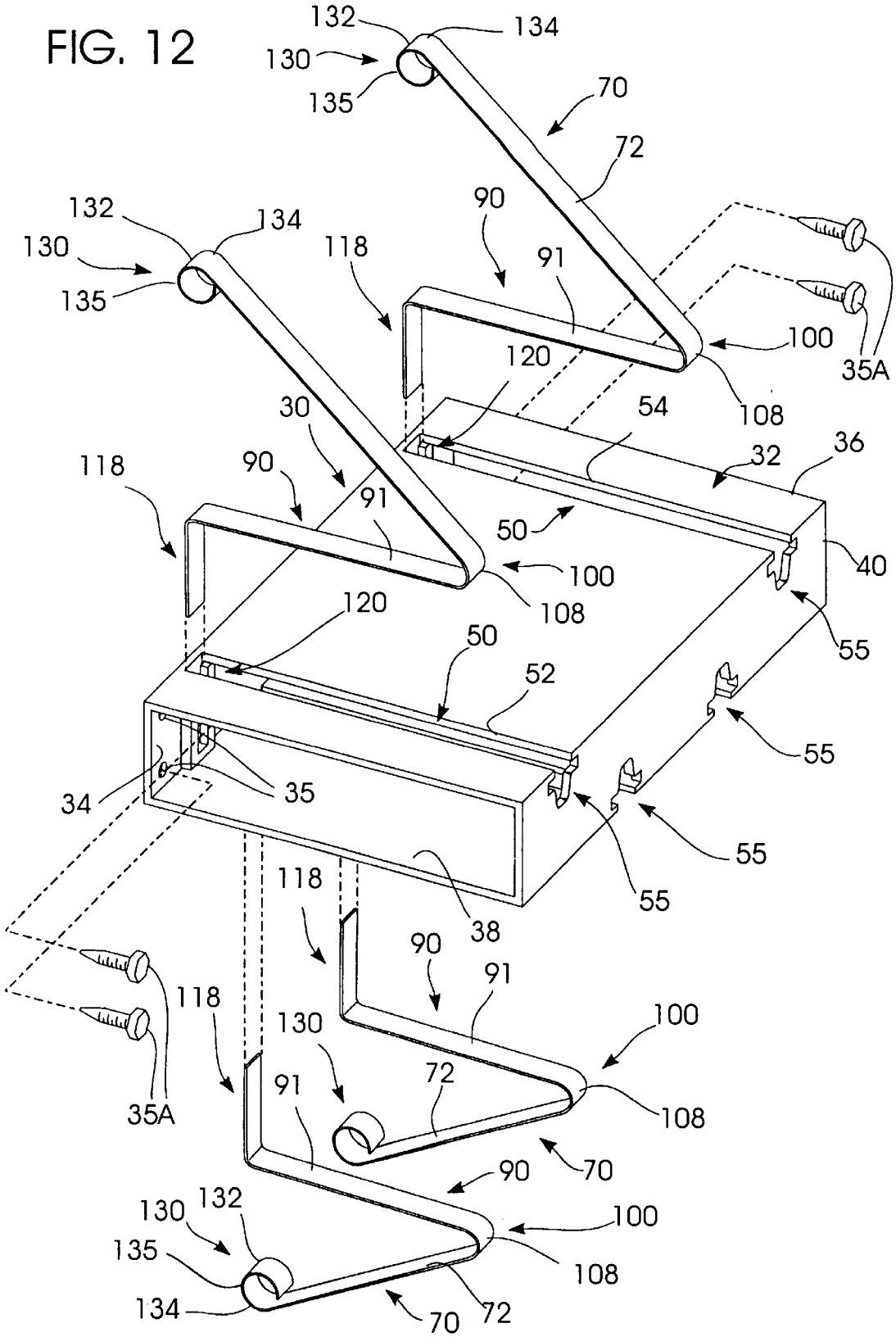
FIG. 12 is an enlarged, exploded isometric view of the alternative embodiment of the invention with portions broken away or omitted for clarity.

In the alternative embodiment (FIGS. 2, 4 and 10), leg 70 is slightly different. Preferably, leg 70 is formed from a resiliently deformable metal. Leg 70 still comprises an elongated body 72 that extends from an integral foot 90 to a terminal resilient end 109. However, alternative leg 70 does not slide horizontally along slot 50. Instead, alternative leg 70 moves arcuately through slot 50 as shown by arrow 97 in FIG. 10. Moreover, biasing assembly 100 comprises the terminal, arcuate segment 108 of body 72 adjacent foot 90 (FIGS. 4, 10, 12). Segment 108 still biases terminal end 130 against door 26 while permitting end 130 to move rearwardly, as shown by arrow 99 (FIG. 10). Also, the retaining assembly 110 comprises a terminal clip 118 (FIG. 12) that inserts directly into sheath 120.

Figure 14:
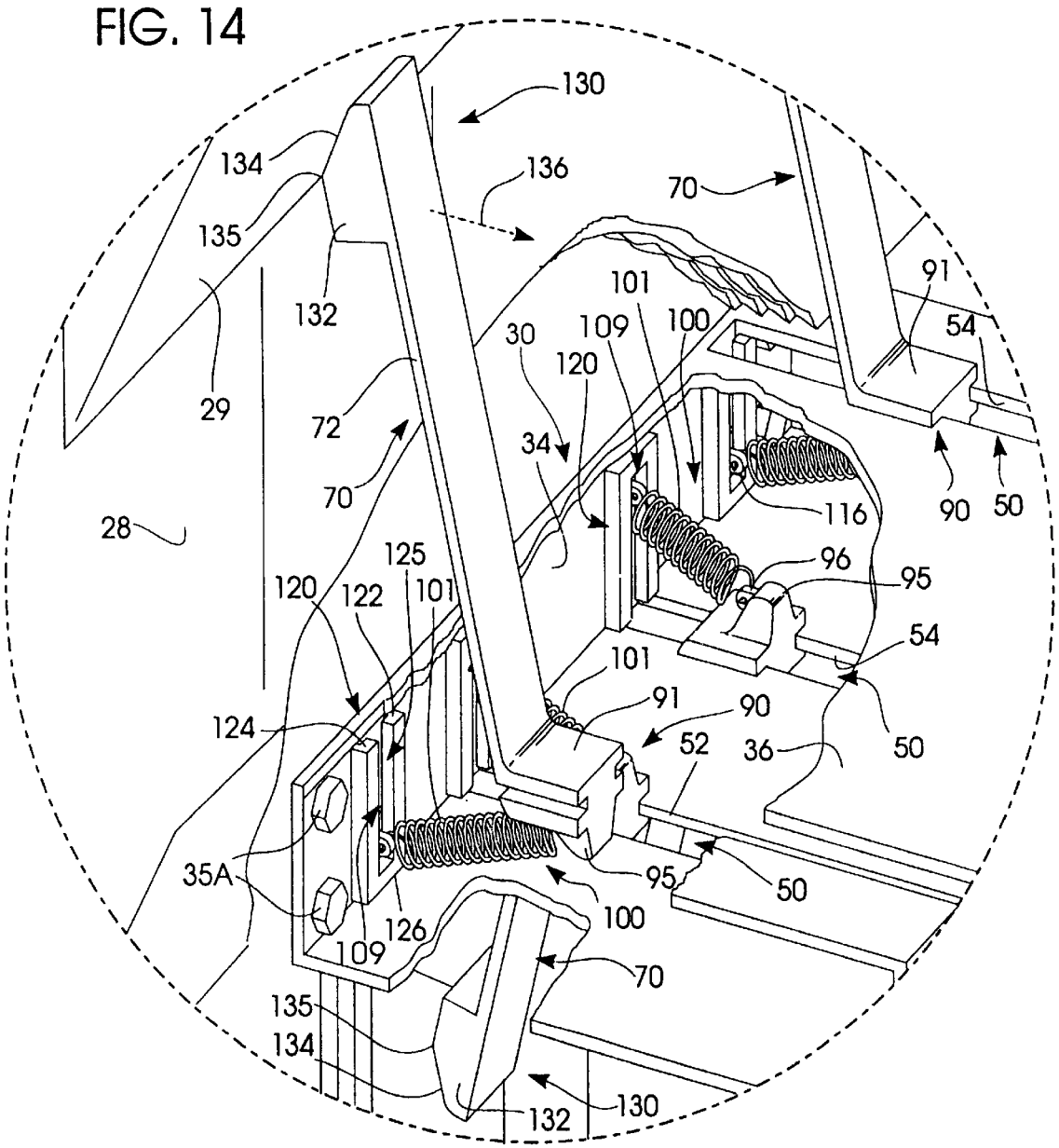

Sheath 120 comprises two parallel, spaced apart arms 122, 124 that define a notch 125 therebetween (FIG. 14). Notch 125 terminates at bottom 126.

Notch 125 captivates retention assembly 110, specifically clip 112 of the preferred embodiment or clip (FIG. 11) 118 of the alternative embodiment (FIG. 12).

Figure 9:
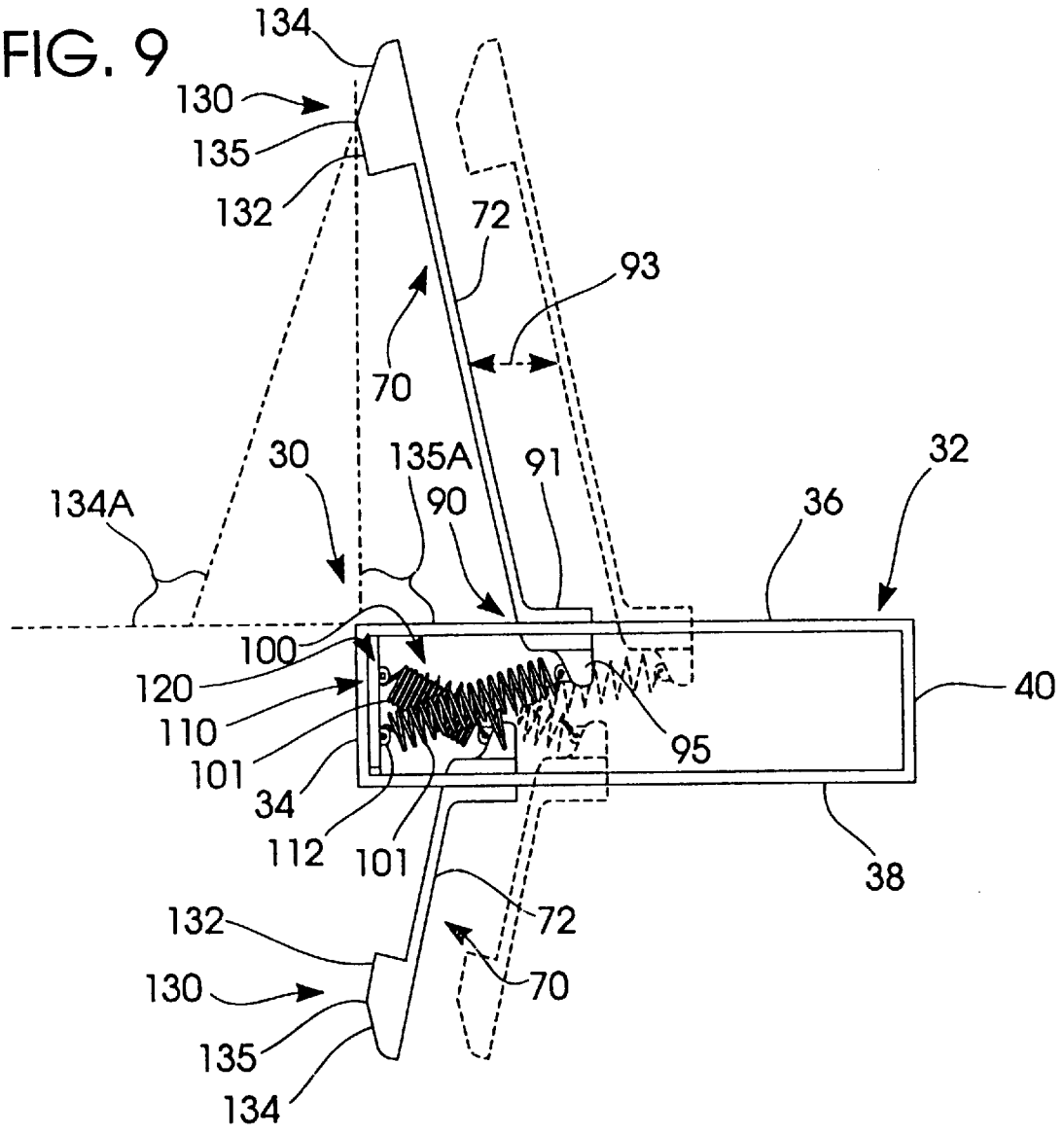
FIG. 9 is a partially fragmented, side elevational view of the preferred embodiment with portions broken away or omitted for clarity, with the dashed lines showing a moved position.

The terminal end 130 comprises a resilient keeper 132 with a sloped entry face 134 (FIGS. 9,10). Sloped face 134 facilitates insertion of sacks by providing an obtuse entry angle 134A with panel 36 or 38 that is preferably between 120 and 140 degrees, most preferably 130 degrees (FIG. 9). A catch 135 frictionally secures inserted bags in place. Preferably, catch 135 forms a holding angle 135A with panel 36 (FIG. 1) or 38 that approximates 90 degrees.

OPERATION

Holder 25 is best installed on a cabinet door 26. In the best mode an ideal place to mount holder 25 is on the interior surface of the kitchen sink door. Care should be taken to allow enough clearance space for the door to close easily. Holder 25 may also be used to selectively segregate sack of different sizes (i.e., separate large sacks from smaller sacks as shown in FIGS. 1–2 and 13–14).

Since larger sacks are normally heavier than smaller sacks, primary panel 36 is designed to transfer a portion of the increased weight to the door 26. Thus, the keepers 132 are not required to frictionally hold the entire sack weight making holder 25 more dependable (FIGS. 1,2).

On the other hand, the same number of smaller sacks weigh correspondingly less if they are made from the same material. Thus, the auxiliary panel keepers 132 should be able to secure the same of number of smaller sacks even though more weight depends directly upon the keepers.

Figure 13:
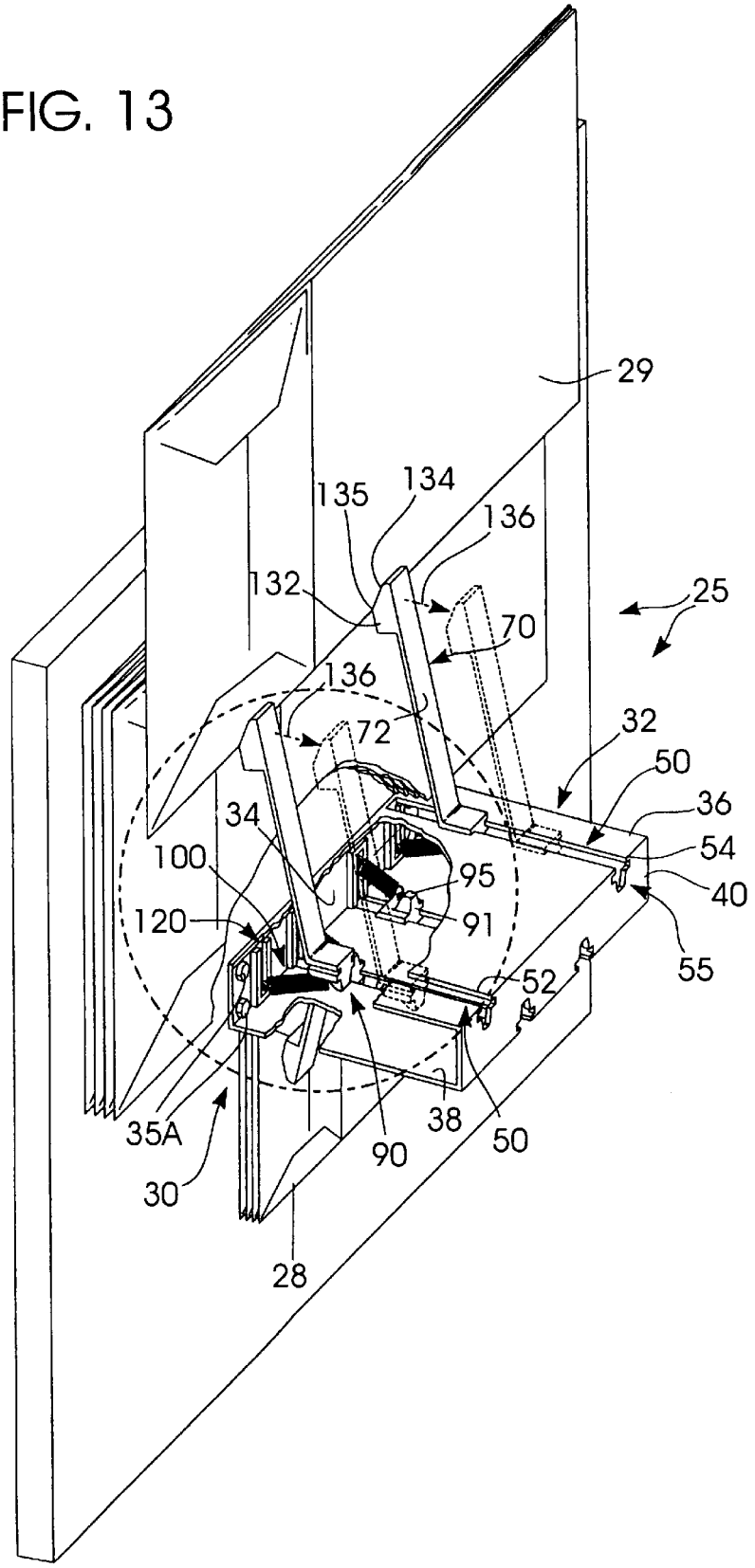
FIG. 13 is a partially fragmented, environmental view of a preferred embodiment of my bag holder and dispenser with a bag being inserted therein, with portions broken away or omitted for clarity and with the dashed lines showing a moved position; and, FIG. 14 is a partially fragmented, greatly enlarged view of the encircled area of FIG. 13, with portions broken away or omitted for clarity.

During use, an operator simply inserts a sack 29 between the ends 130 and the stored sacks 28 (FIGS. 13–14). Sacks should be held on their bottom edges when being inserted. Sack insertion is facilitated by angle 134A on entry face 134. The operator's downward pressure on sack 29 forces each leg 70 to move rearwardly, as indicated by arrows 136. The sack 29 then enters the storage area where it remains until dispensed. After sack 29 is seated in the storage area, biasing assembly 100, either spring 101 (FIG. 14) or segment 108 (FIG. 12), forces end 130 against the newly inserted sack 29. Catch 135 is then positioned against sack 29 to retain it until the operator pulls the sack away from the panel to dispense it.

As sacks are dispensed, biasing assembly 100 forces leg 70 to move toward, the door 26. Thus properly positioning catch 135 against the next sack.

From the foregoing, it will be seen that this invention is one well adapted to obtain all the ends and objects herein set forth, together with other advantages; which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A sack dispensing apparatus comprising:

a resilient, generally parallelepiped housing adapted to be secured to a generally planar mounting surface, said housing comprising an upper flat panel, a lower auxiliary panel, a front base adapted to contact the mounting surface, a rear base spaced apart from said front base and parallel therewith, each base extending vertically between the upper panel and the auxiliary panel;

at least one elongated slot formed in the upper panel and extending generally between said bases;

at least one protruding leg comprising a foot engaging said slot, an integral tab, and an integral remote end resiliently projecting towards said mounting surface, each foot comprising groove means for enabling it to be slidably captivated within said slot grooves;

spring means coupled to each leg tab within the housing for yieldably biasing the leg towards said mounting surface so that one or more generally planar articles may be removably, temporarily retained by said leg ends;

clip means for anchoring said spring means; and, sheath means defined within the housing on the front base for slidably captivating said clip means.

* * * * *